US008028613B2

(12) United States Patent
Wrede et al.

(10) Patent No.: US 8,028,613 B2
(45) Date of Patent: Oct. 4, 2011

(54) VALVE SYSTEM FOR DRILLING SYSTEMS

(75) Inventors: Stefan Wrede, Kirchhundem (DE); Christof Kruse, Wenden (DE)

(73) Assignee: Longyear TM, Inc., South Jordan, UT (US)

( * ) Notice: Subject to any disclaimer, the term of this patent is extended or adjusted under 35 U.S.C. 154(b) by 0 days.

(21) Appl. No.: 12/768,066

(22) Filed: Apr. 27, 2010

(65) Prior Publication Data

US 2010/0276023 A1 Nov. 4, 2010

Related U.S. Application Data

(60) Provisional application No. 61/173,901, filed on Apr. 29, 2009.

(51) Int. Cl.
*F15B 13/042* (2006.01)

(52) U.S. Cl. ..... 91/420; 91/436; 91/437

(58) Field of Classification Search ..... 91/420, 91/436, 437

See application file for complete search history.

(56) References Cited

U.S. PATENT DOCUMENTS

| | | | | |
|---|---|---|---|---|
| 4,205,591 | A * | 6/1980 | Mickelson | 91/436 |
| 5,826,486 | A | 10/1998 | Shimada | |
| 5,996,465 | A * | 12/1999 | Morikawa et al. | 91/420 |
| 2004/0221714 | A1 | 11/2004 | Bitter et al. | |
| 2005/0247188 | A1 | 11/2005 | Jeon | |
| 2009/0077957 | A1 | 3/2009 | Noble et al. | |

OTHER PUBLICATIONS

International Search Report dated Dec. 17, 2010 as issued in connection with corresponding PCT Application No. PCT/US2010/032736, filed on Apr. 28, 2010.

* cited by examiner

*Primary Examiner* — Michael Leslie
(74) *Attorney, Agent, or Firm* — Workman Nydegger

(57) ABSTRACT

A valve system includes a load holding valve, a feed balancing valve, and a fast feed differential valve. The load holding valve may be in fluid communication with the load holding valve. The fast feed differential valve is configured to move between an engaged state and a disengaged state. In the engaged state the fast feed differential valve fluidly couples a ring side of a feed cylinder, the load holding valve, and a piston side of the feed cylinder to allow fluid to flow from the ring side to the piston side.

26 Claims, 13 Drawing Sheets

VALVE SYSTEM FOR DRILLING SYSTEMS

RELATED APPLICATIONS

This application claims the benefit of U.S. Provisional Patent Application Ser. No. 61/173,901 filed Apr. 29, 2009 and entitled "VALVE SYSTEM FOR DRILLING SYSTEMS", which is hereby incorporated by references in its entirety.

BACKGROUND OF THE INVENTION

1. The Field of the Invention

The present invention relates to hydraulic control systems for drilling systems and to valve systems in particular.

2. The Relevant Technology

Drilling rigs are often used for drilling holes into various substrates. Such drill rigs often include a drill head mounted to a mast. The rig often includes mechanisms and devices that are capable of moving the drill head along at least a portion of the mast. The drill head often further includes mechanisms that receive and engage the upper end of a drill rod or pipe. The drill rod or pipe may be a single rod or pipe or may be part of a drill string that includes a cutting bit or other device on the opposing end, which may be referred to as a bit end.

The drill head applies a force to the drill rod or pipe which is transmitted to the drill string. If the applied force is a rotational force, the drill head may thereby cause the drill string to rotate within the bore hole. The rotation of the drill string may include the corresponding rotation of the cutting bit, which in turn may result in cutting action by the drill bit. The forces applied by the drill head may also include an axial force, which may be transmitted to the drill string to facilitate penetration into the formation.

The axial force, the drill head exerts on the drill strings may be controlled by a plurality of valves coupled to a feed cylinder. Often, the connections between the valves and associated controls and between the valves and the cylinder can be complicated.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF INVENTION

A valve system includes a load holding valve, a feed balancing valve, and a fast feed differential valve. The load holding valve may be in fluid communication with the load holding valve. The fast feed differential valve is configured to move between an engaged state and a disengaged state. In the engaged state the fast feed differential valve fluidly couples a ring side of a feed cylinder, the load holding valve, and a piston side of the feed cylinder to allow fluid to flow from the ring side to the piston side.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

A valve block assembly, valve system, and drilling system are provided that are configured to control the extension and retraction of a feed cylinder for controlling the position of a rotary drilling head along a drill mast. In at least one example, the valve assembly may include several valves integrated into a valve block. Such a configuration may reduce the number of fittings and hydraulic lines associated with the control of a valve assembly, which may in turn reduce the likelihood that lines will be improperly routed or that fittings and/or connections may become loose. Further, as will be described in more detail below, valve systems may be provided that allow for a wide range of operating speeds to facilitate rapid feed operations as well as high-force operations.

For ease of reference, the valve assemblies described below will be described in the context of a feed cylinder coupling a rotary drill head to a mast. It will be appreciated that the valve assemblies may also be used with other types of hydraulic systems in any type of operations, including other drilling operations.

Figure 1:
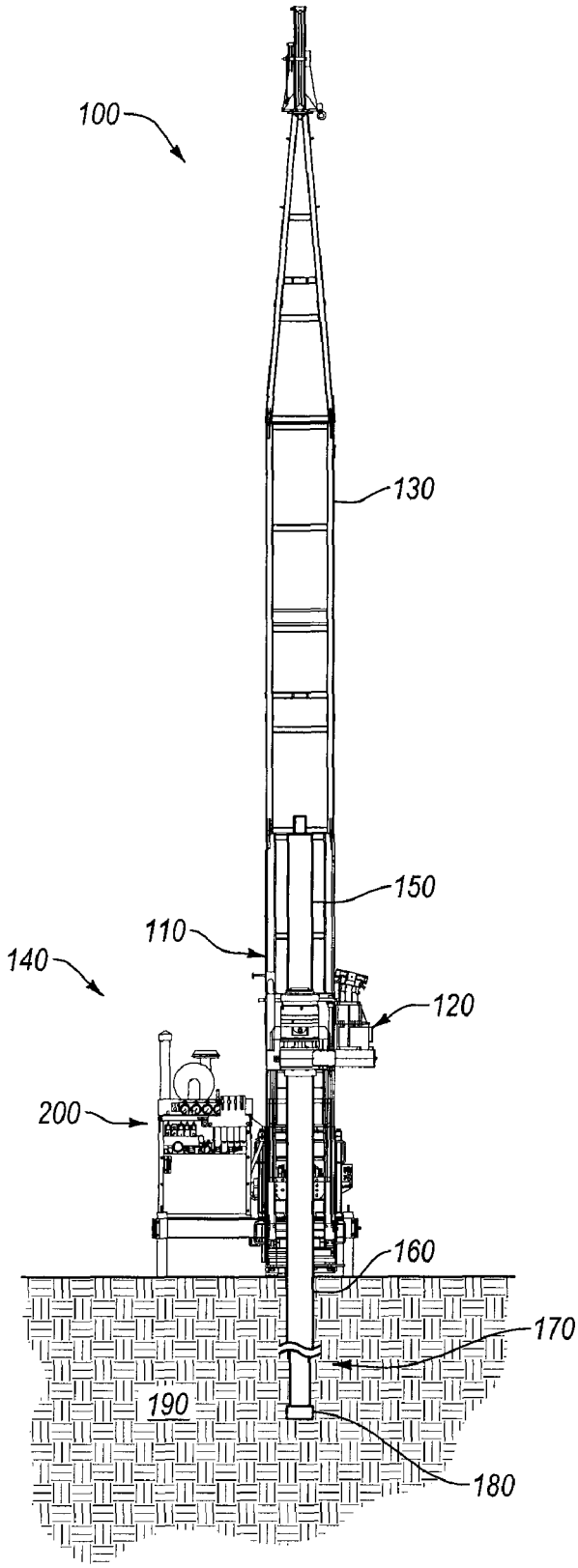
FIG. 1 illustrates a drilling system according to one example.

FIG. 1 illustrates a drilling system 100 that includes a sled assembly 110 and a rotary drill head 120. The sled assembly 110 can be coupled to a mast 130 that in turn is coupled to a drill rig 140. The position of the sled assembly 110, and thus the position of the rotary drill head 120, may control the extension and refraction of a feed cylinder 150.

In at least one example, the drill head 120 is configured to have one or more threaded member(s) 160 coupled thereto. Threaded members 160 can include, without limitation, drill rods and rod casings. For ease of reference, the threaded member 160 will be described as a drill rod. The drill rod 160 can in turn be coupled to additional drill rods to form a drill string 170. In turn, the drill string 170 can be coupled to a drill bit 180 or other down-hole tool configured to interface with the material to be drilled, such as a formation 190.

The drilling system 100 may be configured to exert rotary as well as axial or thrust forces on the drill string 170. In at least one example, the rotary drill head 120 illustrated in FIG. 1 is configured to rotate the drill string 170 during a drilling process. In the illustrated example the feed cylinder 150 may be configured to provide the axial or thrust forces on the drill string 170. In particular, the feed cylinder 150 may retract to thereby cause the rotary drill head 120 to move toward the bottom of the mast 130. As the rotary drill head 120 moves toward the bottom of the mast 130, the rotary drill head 120 exerts a thrust force on the drill string 170 to thereby urge the bit 180 into the formation 190.

In the illustrated example, the extension and retraction of the feed cylinder 150 controlled by an integrated valve system 200, which in turn may be manipulated as desired by any number of controls. The valve system 200 may be configured to provide for multiple operating speeds while also allowing the feed cylinder 150 to exert desired thrust forces. Operation of the valve system 200 as will now be discussed in more detail.

FIGS. 2A-2D illustrates a diagrammatic view of the valve system 200. The separation as a valve assembly and a various controls is provided for ease of reference only. It will be appreciated that components of each assembly may be integrated into the other assembly or different assemblies as desired without departing from the scope of the disclosure.

As illustrated in FIG. 2A-2D, the valve system 200 may generally include a valve block assembly 202 having a valve block 203 into which any number of valves may be integrated as desired to control operation of the feed cylinder 150.

The feed cylinder 150 may include piston side 150A and a ring side 150B each coupled to the valve block assembly 202. More specifically, line 152 may couple the piston side 150A to outlet O1 of the valve block 203 while line 150 may couple the ring side 150B to outlet O2 of the valve block 203. The valve system 200 may be switched between a holding mode and a plurality of feed modes by controlling the 1 flow of fluid into and out of the feed cylinder 150.

In particular, in a holding mode, the valve system 200 may hold the feed cylinder 150 at a desired extension by preventing a flow of fluid out of the piston side 150A of the feed cylinder 150. In the various feed modes, the valve system 200 allows fluid to flow into and out of feed cylinder 150 to achieve desired extension and retraction of the feed cylinder 150. More specifically, the feed cylinder 150 may be extended by directing fluid to the piston side 150A and/or withdrawing fluid from the ring side 150B. Similarly, the feed cylinder 150 may be retracted by directing fluid to the ring side 150B and/or withdrawing fluid from the piston side 150A. For ease of reference, extension of the feed cylinder 150 will be described as raising a rotary drill head while retraction of the feed cylinder 150 will be described as lowering a rotary drill head. It will be appreciated that this may be reversed as desired.

Holding, extension, and retraction may be controlled by selectively openings valves that may include, without limitation, a load holding valve 205, a feed balancing valve 210, a fast-feed differential valve 220, a safety valve 230, a feed directional valve 240, and a fast feed directional valve 250. The general functionality of these valves and their corresponding controls will first be introduced, followed by a more detailed discussion of the holding and feed modes.

Still referring to FIGS. 2A-2D, the load holding valve 205 be configured to prevent flow of fluid out of the piston side 150A, thereby maintaining pressure in the piston side 150A to hold the feed cylinder 150 in a desired extension. The load holding valve 205 may be configured to maintain this pressure in the absence of other inputs, such that the actuation of the load holding valve 205 may be a default state for the valve system 200.

As shown in FIGS. 2A-2D, the feed balancing valve 210 may be configured to balance pressure acting on the piston side 150A of the feed cylinder 150 to balance forces associated with the weight of a drill string. The feed balancing valve 210 may be a cartridge type valve. In at least one example, the feed balancing valve 210 may be controlled by the feed balancing pilot control 310.

The fast feed differential valve 220 may act to selectively facilitate flow of fluid between the ring side 150B of the feed cylinder 150 to the piston side 150A. Flowing the fluid from the ring side 150B to the piston side 150A instead of to tank may increase the speed with which the feed cylinder 150 may be extended. In the illustrated example, the fast feed differential valve 220 may be controlled by a fast feed pilot control 320.

Pressure spikes may occur when the fast feed differential valve 220 switches from a non-engaged state to an engaged state. In the illustrated example, the safety valve 230 may be associated with the fast feed differential valve 220 to prevent pressure spikes from reaching the ring side 150B of the feed cylinder 150. Accordingly, the safety valve 230 may help facilitate switching of the fast feed differential valve 220.

The feed directional valve 240 and the fast feed directional valve 250 are operatively associated with a feed pump 340 and a fast feed pump 350 respectively. Though shown separately, it will be appreciated that the functionality described below with reference to the feed pump 340 and the fast feed pump 350 may be provided by a single pump in communication with the feed direction valve 240 and the fast feed direction valve 250. It will be appreciated the feed directional valve 240 and the fast feed directional valve 250 may be implemented as spool valves in a single control block of in different control blocks. In at least one example, the feed directional valve 240 and/or the fast feed directional valve 250 may be spool-type valves, though it will be appreciated that other types of valves may be used. The feed direction valve 240 and the fast feed directional valve 250 selectively direct fluid to the feed directional valve 240 and the fast feed directional valve 250 to selectively switch the valve system 200 between the holding mode introduced above and several feed modes, which will be discussed in more detail below.

In the illustrated example, the feed directional valve 240 and the fast feed directional valve 250 may be switched independently. In such a configuration, if neither the feed directional valve 240 nor the fast feed directional valve 250 is switched to direct fluid to the valve block assembly 202, the valve system 200 is in a holding mode. However, if the feed directional valve 240 and/or the fast feed directional valve 240 are switched to direct fluid to valve block assembly 202, the valve system 200 may be switched to one of the several feed modes. The holding mode will first be discussed in more detail with reference to FIG. 2A, followed by a discussion of the various feed modes.

Figure 2A:
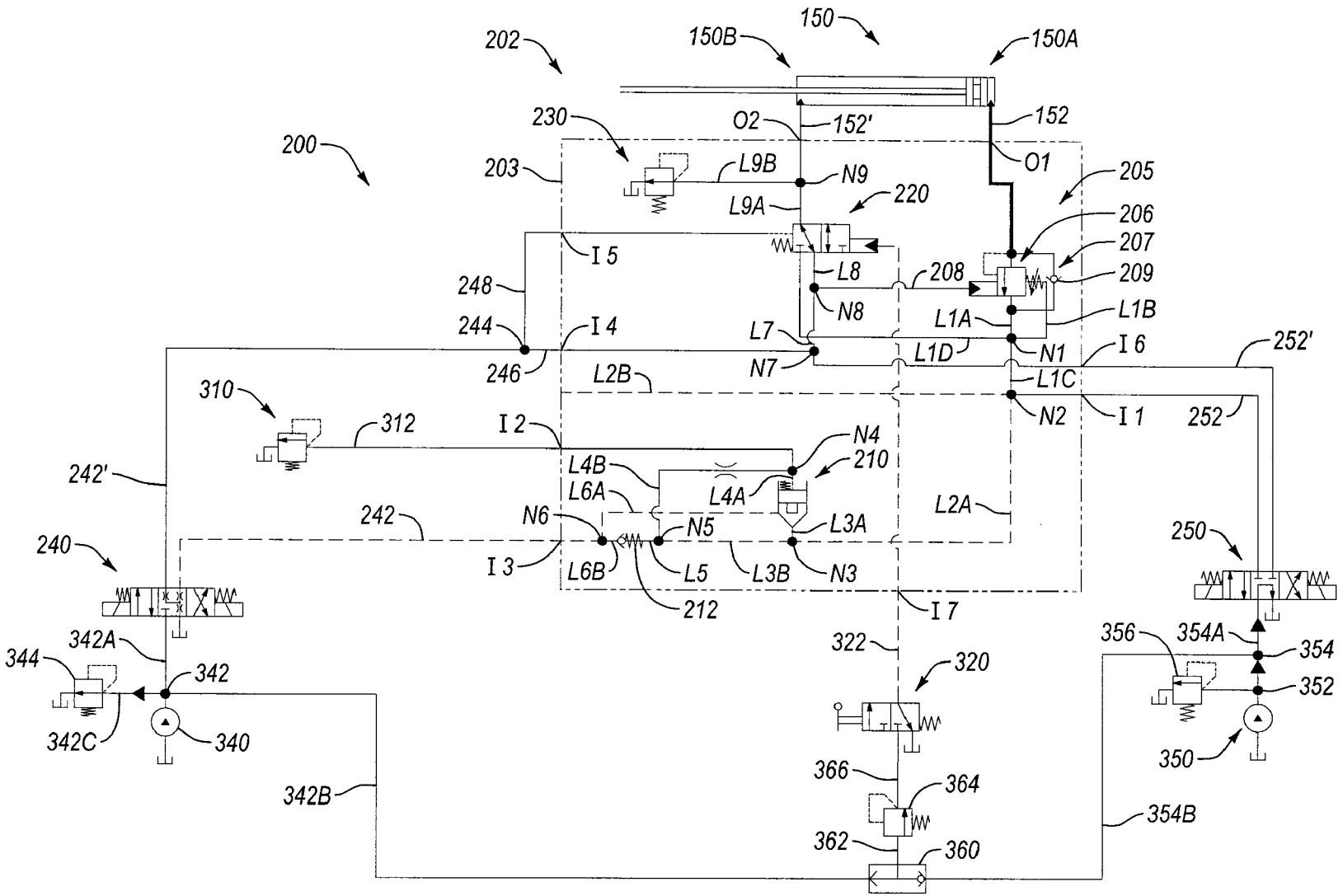
FIG. 2A illustrates a diagrammatic view of a valve system in a holding mode according to one example.

As illustrated in FIG. 2A, the load holding valve 205 generally includes pressure holding valving 206 and proportional valving 207. Both the pressure holding valving 206 and the proportional valving 207 are in communication with outlet O1, which in turn is in communication with the piston side 150A of the feed cylinder 150 by way of line 152. The pressure holding valving 206 is operatively associated with an actuator line 208 in such a way that pressure in the actuator line 208 acts to switch the pressure holding valving 206 from a closed state to an open state. However, if fluid from the actuator line 208 is not acting to open the pressure holding valving 206, the pressure holding valving 206 will remain in the closed state as shown.

In the closed state, the pressure holding valving 206 prevents fluid from flowing from outlet O1 through the pressure holding valve 205. In the illustrated example, the load holding valve 205 also includes a check valve 209 that prevents fluid from passing from the outlet O1 through the proportional valving 207. Accordingly, in the absence of an input from the actuator line 208, the load holding valve 205 prevents fluid from passing through the load holding valve 205. Such a configuration can help maintain pressure in the piston side 150A of the feed cylinder 150, thereby holding the feed cylinder 150 at a desired extension.

As previously introduced, switching either of the feed directional valve 240 or the fast feed directional valve 250 to direct fluid to the valve block assembly 202 results in the valve system 200 switching to one of several feed mode. In particular, the feed directional valve 240 may be switched between a closed state, an open extension state, and an open retraction state. In a closed state, any fluid directed to the feed directional valve 240 is blocked or outlet to tank. In an open retraction state, the feed directional valve 240 is switched to direct fluid to cause or allow the feed cylinder 150 to retract. Similarly, while the feed directional valve 240 is in an open extension state, the feed directional valve 240 is switched to cause or allow the feed cylinder 150 to extend.

Similarly, the fast feed directional valve 250 may be switched between a closed state, an open extension state, and an open retraction state. As previously introduced, the feed directional valves 240, 250 may be operated independently. Such a configuration allows the feed directional valves 240, 250 to work separately or in concert to provide several feed modes. These include, without limitation, feed only extension and retraction, fast feed only extension and refraction, and feed/fast feed extension and retraction.

While the feed directional valve 240 and/or the fast feed directional valve 250 are in an open extension state, the fast feed differential valve 220 may be actuated to provide additional feed modes including feed only plus differential, fast feed only plus differential, and feed/fast feed plus differential. Accordingly, the independent switching of the feed directional valve 240, the fast feed directional valve 250, and the fast feed differential valve 220 can provide a wide range of feed modes. The feed modes associated with operation of the feed directional valve 240 alone will first be discussed.

Figure 2B:
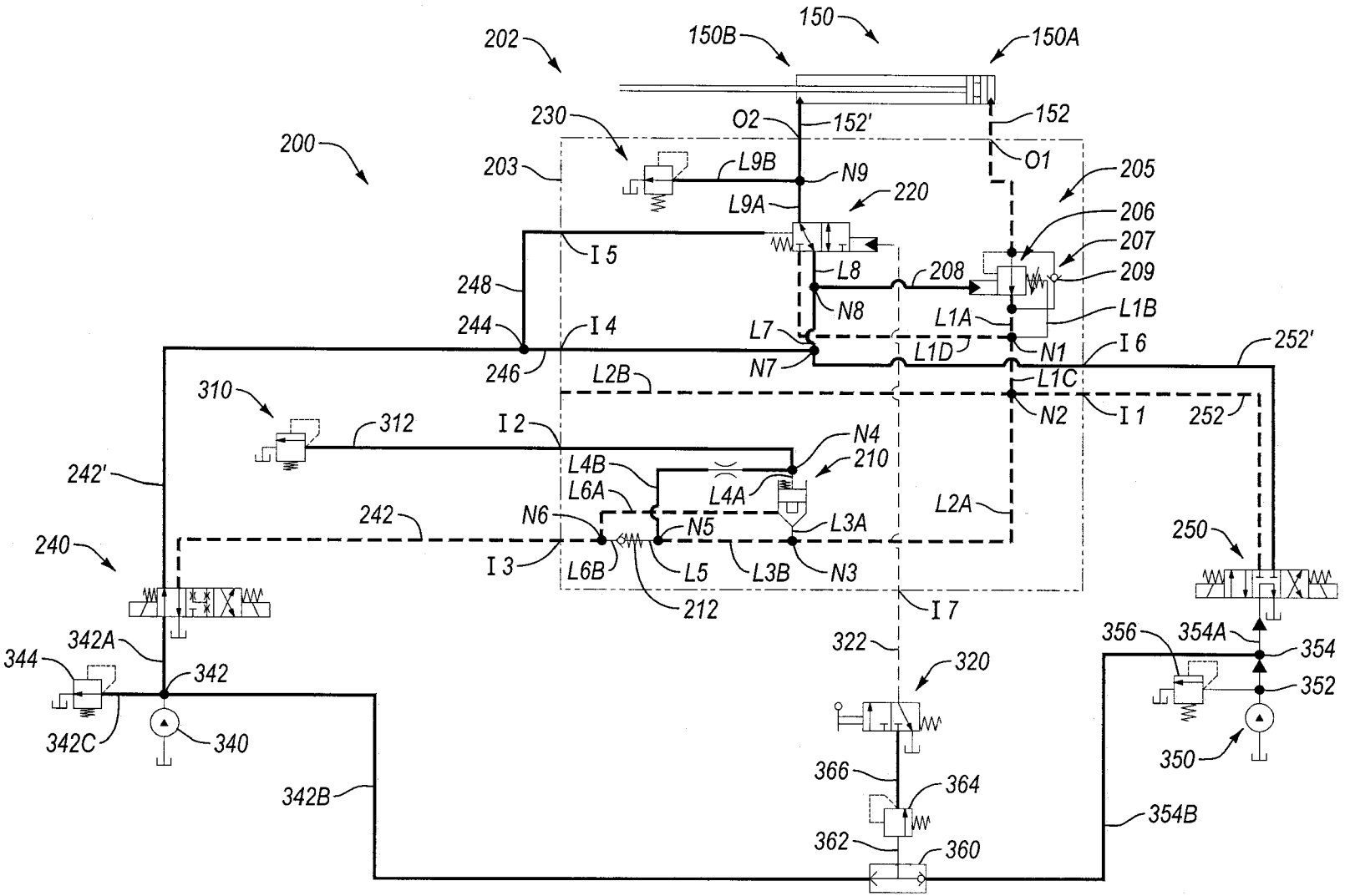
FIG. 2B illustrates a diagrammatic view of a valve system in a feed refraction mode according to one example.

FIG. 2B illustrates a feed only retraction mode. FIG. 2B also illustrates the operation of the feed balancing valve 210. As illustrated in FIG. 2B, in a feed only retraction mode, a pathway is established between the piston side 150A of the feed cylinder 150 and the feed directional valve 210. In particular, the pressure holding valving 206 and the proportional valving 207 are both in communication with a first node N1 by way of lines L1A and L1B respectively.

A pathway between outlet O1 and line L1A may be established by providing an input on the actuator line 208 to move the pressure holding valving 206 to the open state shown. The input may be provided by switching the feed directional valve 240 to the position shown to establish a pathway between the feed pump 340 and the actuator line 208. The pathway will be described in more detail after a brief discussion of the operation of the feed balancing valve 210.

As illustrated in FIG. 2B, moving the pressure holding valving 206 to the open state allows fluid to flow through the load holding valve 205 to node N1. Node N1 is in further communication with lines L1C and L1D. Line L1D is in communication with a closed port of the fast feed differential valve 220 while line L1C is in communication with node N2. Accordingly, in the feed only retraction node, fluid incident on node N1 is directed to node N2.

Node N2 is in communication with inlet I1, line L2A, and line L2B. Inlet I1 may be in communication with the fast feed directional valve 250 by way of line 252. In feed only modes, line 252' is in communication with a closed port of the fast feed differential valve 250. Line L2B may be omitted or capped as desired. As a result, fluid incident on node N2 may be directed through line L2A to node N3.

Node N3 is in communication with lines L3A and L3B. Line L3A is in communication with the feed balancing valve 210. In particular, fluid from L3A may exert an opening pressure force on the feed balancing valve 210 that acts to open the feed balancing valve 210.

An opposing force may be exerted on an opposing side of the feed balancing valve 210 by fluid directed to the feed balancing valve 210 from the feed balancing pilot control 310. The feed balancing pilot control 310 may be a pressure control valve, which controls the pressure in the piston side chamber of the cartridge valve. In at least one example, if the pressure setting of the feed balancing pilot control 310 is adjusted, the feed balancing valve 210 can open when the pressure in line L3A is two times higher than the pressure in line 312. Otherwise, the feed balancing valve 210 remains closed. In at least one example, the feed balancing valve 210 may be a cartridge-type valve that can be configured for use with different feed cylinders by selecting or adjusting sizes of orifices placed in line L4B to provide different variances and opening times. In particular, the feed balancing valve 210 may also be in communication with node N4 by way of line L4A. Node N4 may also be in communication with outlet I2 and line L4B. Line 312 may couple the feed balancing pilot control 310 to the outlet I2, thereby establishing fluid communication between the feed balancing pilot control 310 and the feed balancing valve 210. The fluid the feed balancing pilot control 310 receives from the feed balancing valve 210 exerts a closing pressure force on the feed balancing valve 210 to maintain the feed balancing valve 210 closed. This closing pressure force is in opposition to the opening pressure force associated with line L3A. Accordingly, by adjusting the pressure force associated with the feed balancing pilot control 310, the feed balancing valve 210 is able to control the pressure in the piston end 150A.

In particular, if the closing pressure force is greater than the opening pressure force, the feed balancing valve 210 will remain closed. If the feed balancing valve 210 is closed, fluid incident on node N3 is blocked from passing through the feed balancing valve 210. Instead, the fluid may be directed though line L3B to node N5. Node N5 is in communication with line L4B and line L5. Line L5 may be in communication with a check valve 212, which prevents fluid from L5 to pass therethrough. Accordingly, when the feed balancing valve 210 remains closed, fluid may flow to the feed balancing pilot control 310 through line L4B, node N4, inlet I2, and line 312 where it is then directed to tank.

If however, the opening pressure force associated with line L3A is greater than the closing pressure force associated with the feed balancing pilot control 310, the feed balancing valve 310 will open to allow fluid to pass therethrough. As the fluid passes through the feed balancing valve 310, the fluid is directed to node N6 through line L6A. Node 6A may also be in communication with lines L6B and inlet I2. Line L6B may be closed by the check valve 212 such that fluid directed to node N6 from the feed balancing valve 210 is directed to inlet I3.

Inlet I3 may be coupled to line 242, which in turn may be coupled to feed directional valve 240. In a feed retraction mode, the feed directional valve 240 may be switched to couple line 242 to tank as shown. With the feed directional valve 240 thus switched, the feed directional valve 240 also couples feed pump 340 to line 242'.

In particular, the feed pump 340 may be in communication with a splitter 342. The splitter 342 may in turn be in communication with lines 342A, 342B, and 342C. Line 342A may be coupled to the feed directional valve 240, line 342B may be coupled to a shuttle valve 360, and line 342C may be in communication with a safety valve 344, which may prevent pressure spikes from reaching the feed directional valve 240 by way of line 342A. The operation a the shuttle valve will be discussed in more detail at an appropriate location hereinafter.

The shuttle valve 360 may be configured to help maintain adequate fluid supply to the fast feed pilot control 320 to allow the fast feed pilot control 320 to switch the fast feed differential valve 220 between engaged state and a disengaged state. In the illustrated example, the shuttle valve 360 is in communication with the fast feed pilot control 320 by way of line 362. Pressure reducing valve 364 may also be in communication with line 366, which may adjust the pressure for engaging the fast feed differential valve 220 via the fast feed pilot control 320 while allowing the fast feed differential valve 220 while allow allowing pressure in line 248 to disengage the fast feed differential valve 220. The fast feed pilot control 320 allows an automatic disengaging of valve 220 by engaging feed retraction without having the need of disengaging valve 220 separately. With the valve 320 the pressure difference between line 248 and 322 can be adjusted in such a way that by engaging the feed retraction mode the pressure to disengage the valve 220 is higher than the pressure for engaging fast feed differential valve 220 and thus the fast feed differential valve 220 is switched to a disengaged state in the absence of pressure from line 322 and inlet I7.

As previously introduced, in a feed retraction mode the output of the feed pump 340 acts to move the pressure holding valving 206 associated with the load holding valve 205 to an open state. In particular, line 242' is in communication with a splitter 244. The splitter 244 may be external to the valve block assembly 203 or may be integrated within the valve block assembly 203 as a node as desired. In the illustrated example, the splitter 244 is in communication with line 246 and line 248. Line 246 may be in communication with inlet I4 while line 248 may be in communication with inlet I5. Inlet I5 may be in communication with the fast feed differential valve 220. As a result, fluid directed to line 248 may act on the fast feed differential valve 220 to help maintain the fast feed differential valve 220 switched to the position shown in FIG. 2B.

Inlet I4 may be in communication with node N7. Node N7 in turn may be in communication with inlet I6 and line L7. Inlet I6 may in turn couple to line 252', which may couple to the fast feed directional valve 250. In feed only modes, line 252' may be coupled to a closed part of the fast feed directional valve 250.

Accordingly, fluid incident on node N7 may be directed to line L7. Line L7 in turn is in communication with node N8. Node N8 is in communication with actuator line 208 and line L8. As a result a portion of the fluid incident on node N8 is directed through the actuator line 208. This fluid may exert sufficient pressure on the pressure holding valving 206 to move the pressure holding valving 206 to the open state shown. Moving the pressure holding valve 206 to the open state shown may allow fluid to drain from the piston side 150A as previously discussed above.

The valve system 200 may be configured to counter the drain of fluid from the piston side 150A by directing fluid to the ring side 150B. In particular, a portion of the fluid incident on node N8 may pass through the fast feed differential valve 220 to node N9 by way of line L9A. Node N9 may be in further communication with outlet O2 and line L9B. As previously introduced, outlet O2 may couple to the ring side 150B of the feed cylinder 150 via line 152'. As a result, a portion of the fluid that is directed to the valve block assembly 202 from the feed pump 340 may be directed to the ring side 150B of the feed cylinder 150.

In the illustrated example, line L9B may be in communication with safety valve 230. As a result, excess fluid directed to node N9 may be directed to tank rather than to the ring side 150B of the feed cylinder 150. As a result, the safety valve 230 may be able to counter pressure spikes directed to node N9 and reduce the likelihood that the pressure spikes will be directed to outlet O2 and from outlet O2 to the ring side 150B of the feed cylinder 150 by way of line 152'.

Figure 2C:
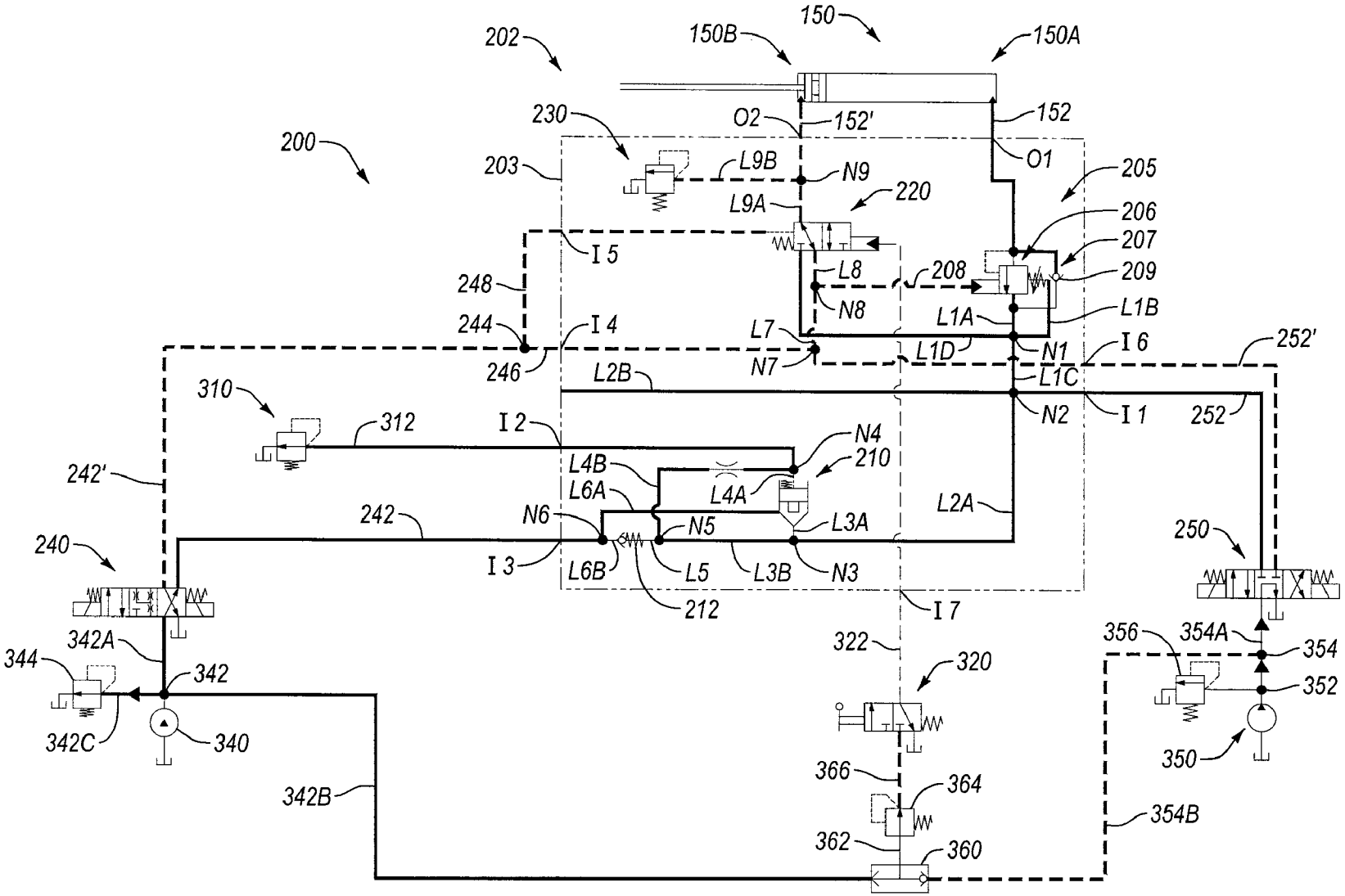
FIG. 2C illustrates a diagrammatic view of a valve system in a feed extension mode according to one example.

FIG. 2C illustrates the valve system 200 in a feed extension mode. In a feed extension mode, the feed directional valve 240 is switched to couple the feed pump 340 to line 242 and to couple line 242' to tank. As a result, fluid flows through line 242, through inlet I3, to node N6. A significant portion of the fluid incident on node N6 passes through node N3 to line L2A. In particular, a portion of the fluid N6 passes through line L6B, opens check valve 212, and is incident on node N5. If the feed balancing valve 210 is closed, fluid will be directed through line L3B, through node N3, through line L2A, and to node N2. If the feed balancing valve 210 is opened, then a portion of the fluid may also pass through line L6A, through the feed balancing valve 210, through line L3A, through node N3, through line L2A and to node N2.

As previously introduced, node N2 is in communication with node N1. Node N1 is in communication with the pressure holding valving 206 by way of line L1A, with the proportional valving 207 by way of line L1B and with a closed port in the fast feed differential valve 220. As shown, in feed refraction mode, the pressure holding valving 206 is closed. As a result, a substantial portion of the fluid incident on node N1 is routed to the proportional valving. This fluid opens the check valve 209 and passes through outlet O1 to the piston side 150A by way of line 152 of the feed cylinder 150. The fluid entering the piston side 150A exerts a pressure force on the feed cylinder 150 to cause the feed cylinder 150 to extend.

As the feed cylinder 150 extends, fluid from the ring side 150B is routed through line 152', into outlet O2, and to node N9. From node N9, the fluid may be directed to tank by passing through the fast feed differential valve 220, which is directed to the fluid through line L8 to node N8, and from node N8 through line L7 to node N7. From N7, the fluid may be directed to tank by way of a pathway between I4, line 242', the feed directional valve 240 and the tank since the pathway from inlet I6 through pathway 252' is coupled to a closed port on the fast feed directional valve 250. The drain pathway described above may be utilized when the fast feed differential valve 220 is not actuated.

Figure 2D:
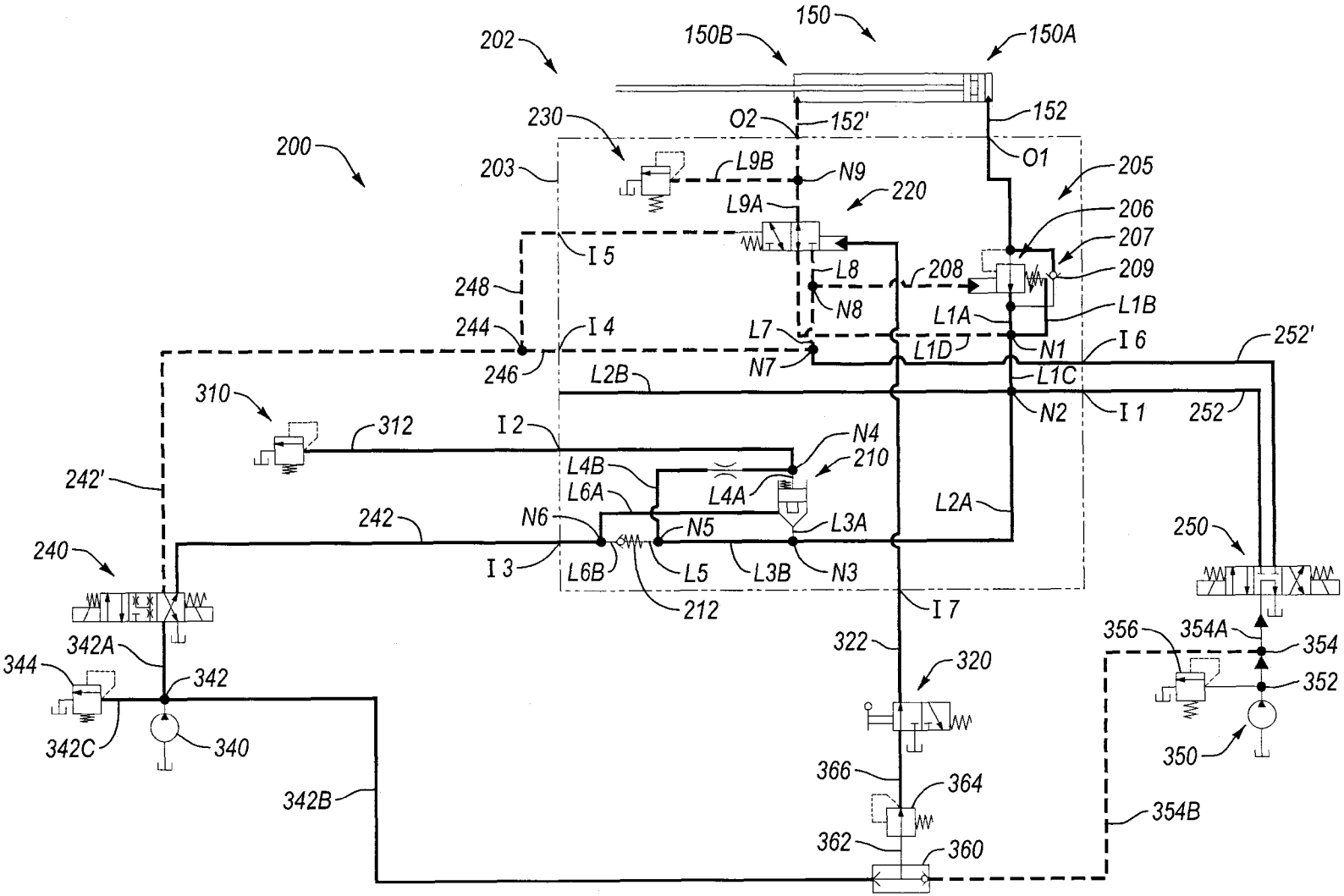
FIG. 2D illustrates a diagrammatic view of a valve system in a feed plus differential extending mode according to one example.

However, as illustrated in FIG. 2D, the fast feed differential valve 220 may be actuated to route fluid from the ring side 150B to the piston side 150A. In particular, the fast feed differential pilot control 320 may be switched to move the fast feed differential valve 220 to the position shown in FIG. 2D. When thus switched, the fast feed differential valve 220 couples line L9A to line LID. Line L1D is incident on node N1. As previously introduced, in a feed extension mode, fluid incident on node N1 is directed to the piston side 150A by way of line LIB, the proportional valving 207, outlet O1, and line 152.

The flow incident on N1 from line L1D may be in addition to the fluid incident on N1 from line L1C, which was directed to node Ni from the feed pump 340. The rate at which the feed cylinder 150 extends depends, at least in part, on the flowrate of fluid into the piston side 150A. Accordingly, the additional volume of fluid associated with directing the fluid draining from the ring side 150B to the piston side 150A may increase how quickly the feed cylinder 150 extends. The force then exerted for extension is the pressure multiple by the surface of the piston side 150A minus the pressure multiplied by the annular surface of the ring side 150B.

Figure 3A:
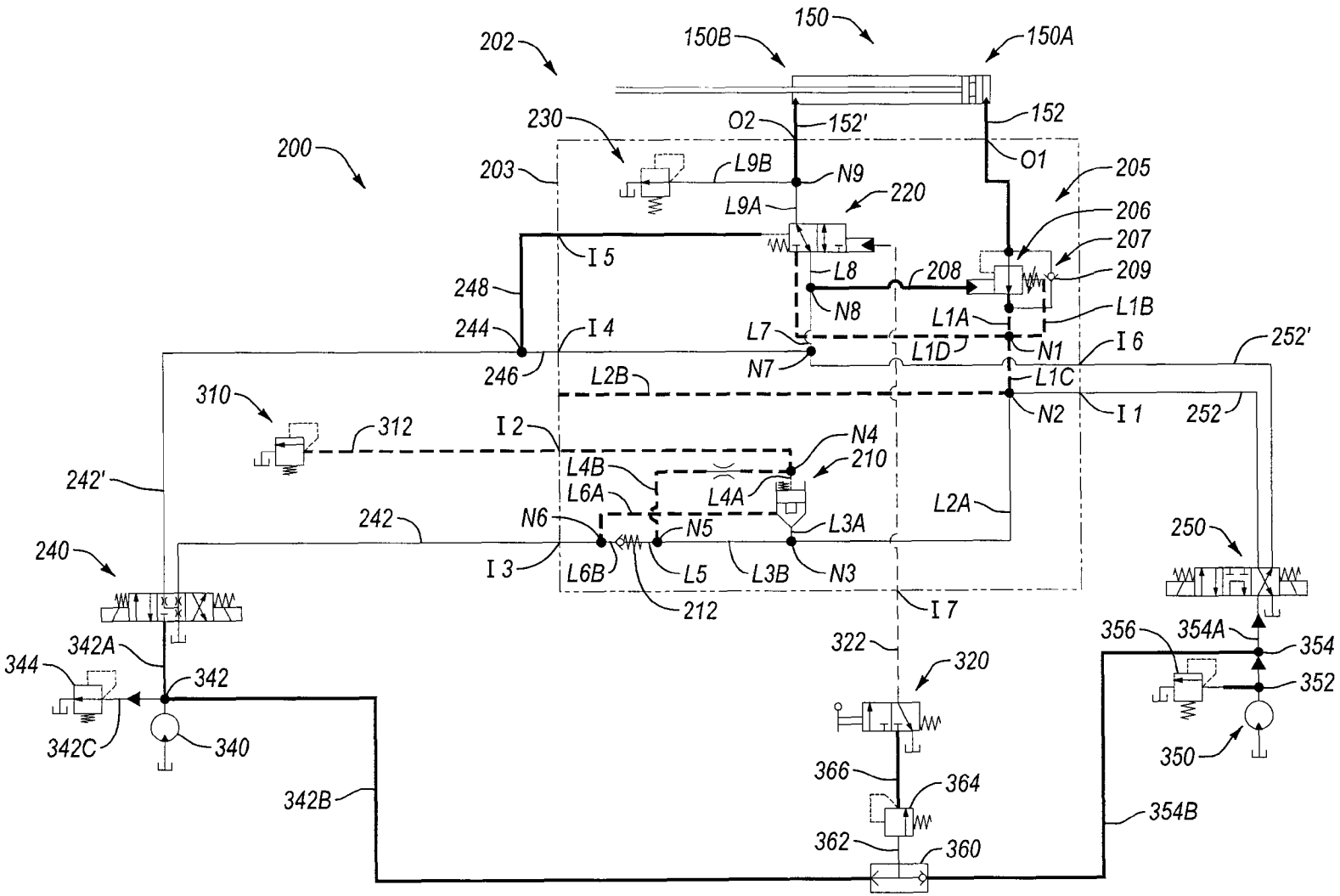
FIG. 3A illustrates a diagrammatic view of a valve system in a fast feed refraction mode according to one example.

FIG. 3A illustrates the valve system 200 in a fast feed only retraction mode. In the fast feed only refraction mode, the feed directional valve 240 is switched to couple lines 242, 242' via orifices to tank to thereby help ensure there is no pressure loss in the line and the feed pump 340 to a closed port. Accordingly, the output of the feed pump 340 is directed to the safety valve 344 via line 324B.

The output of the fast feed pump 350 is routed through line 352 to splitter 354. Splitter 354 routes fluid incident thereon to line 354A, which is coupled to the fast feed directional valve 250, and to line 354B, which is in communication with the shuttle valve 360. Safety valve 356 may also be coupled to the line 352 to help reduce the likelihood that pressure spikes will reach the fast feed directional valve 250 by way of splitter 354.

In the fast feed only retraction mode, the fast feed directional valve 250 is switched to couple line 252 to tank and line 252' to node N7 by way of inlet I6. A portion of the fluid incident on node N7 is directed through line L7 to node N8. Another portion of the fluid incident on node N7 is routed to the feed directional valve 240 to maintain the fast feed directional valve 220 in the desired position by way of inlet I4, splitter 246, line 248, and inlet I5.

From node N8, the fluid from L7 is split between the actuator line 208, which opens the pressure holding portion 206 of the load holding valve 205, and the fast feed differential valve 220 through lines 246 and 248 described above. With the load holding valve 205 open, a pathway is established between the feed piston side 150A of the feed cylinder 150 and node N2. Node N2 is in communication with inlet I1, which is coupled to tank by way of line 252 as described. Node N2 may also be in communication with node N3, which may be coupled to the feed balancing valve 210 as described above. Accordingly, in a fast feed only retraction mode, fluid drains from the piston side 150A of the feed cylinder 150.

Fluid may fill the ring side 150B in opposition to the fluid draining from the piston side 150A. In particular, the fast feed differential valve 220 directs fluid from node N8 to node N9 by way of lines L8 and L9A. Node N9 is in communication with the safety valve 230 via line L9B and with the ring side 150B by way of outlet O2 and line 152'. As a result, a portion of the fluid incident on N9 can fill the ring side 150B while the excess can be directed to tank by way of the safety valve 230 as shown.

Figure 3B:
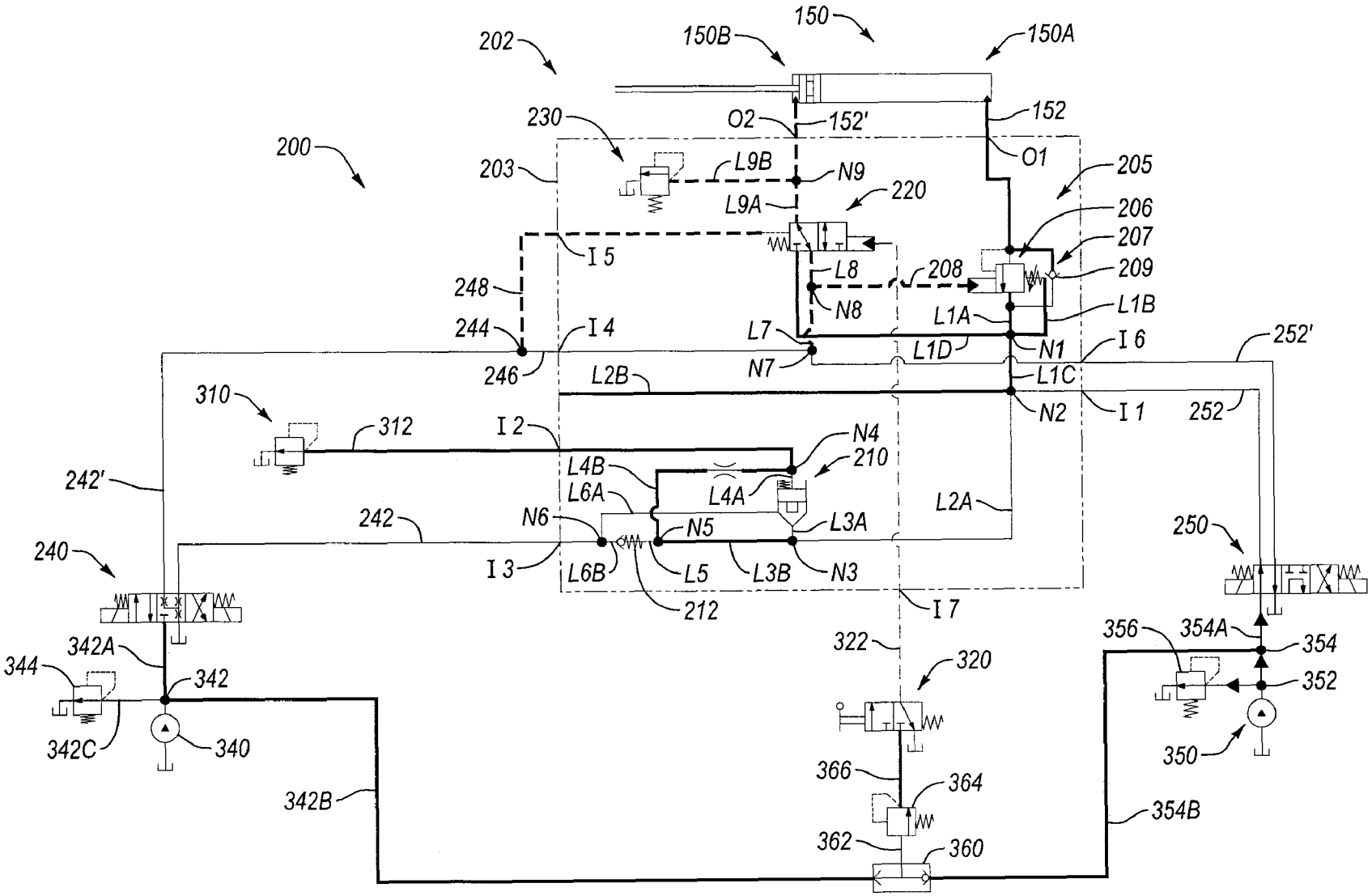
FIG. 3B illustrates a diagrammatic view of a valve system in a fast feed extension mode according to one example.

In the fast feed only extension mode shown in FIG. 3B, the fast feed directional valve 250 is switched to couple the fast feed pump 350 to line 252 and to couple line 252' to tank. In such a configuration, fluid from the fast feed pump 350 is directed through line 252 to node N2. Node N2 is in communication with the load balancing valve 210 by way of line L2A as previously described. Node N2 is also in communication with node N1 by way of line L1C. From node N1, a portion of the fluid is directed to the piston side 150A by way of line L1B, the proportional valving 207 and the check valve 209, outlet O1, line 152, and to the piston side 150A to cause the feed cylinder 150 to extend.

As the feed cylinder 150 extends, fluid drains from the ring side 150B. If the fast feed differential valve 220 is closed, a pathway is established between line 152' and tank through outlet O2, node N9, line L9A, the fast feed directional valve 220, line L8, node N8, line L7, node N7, inlet I6 and line 252'. Line 252' is coupled to tank by the fast feed differential valve 250.

Figure 3C:
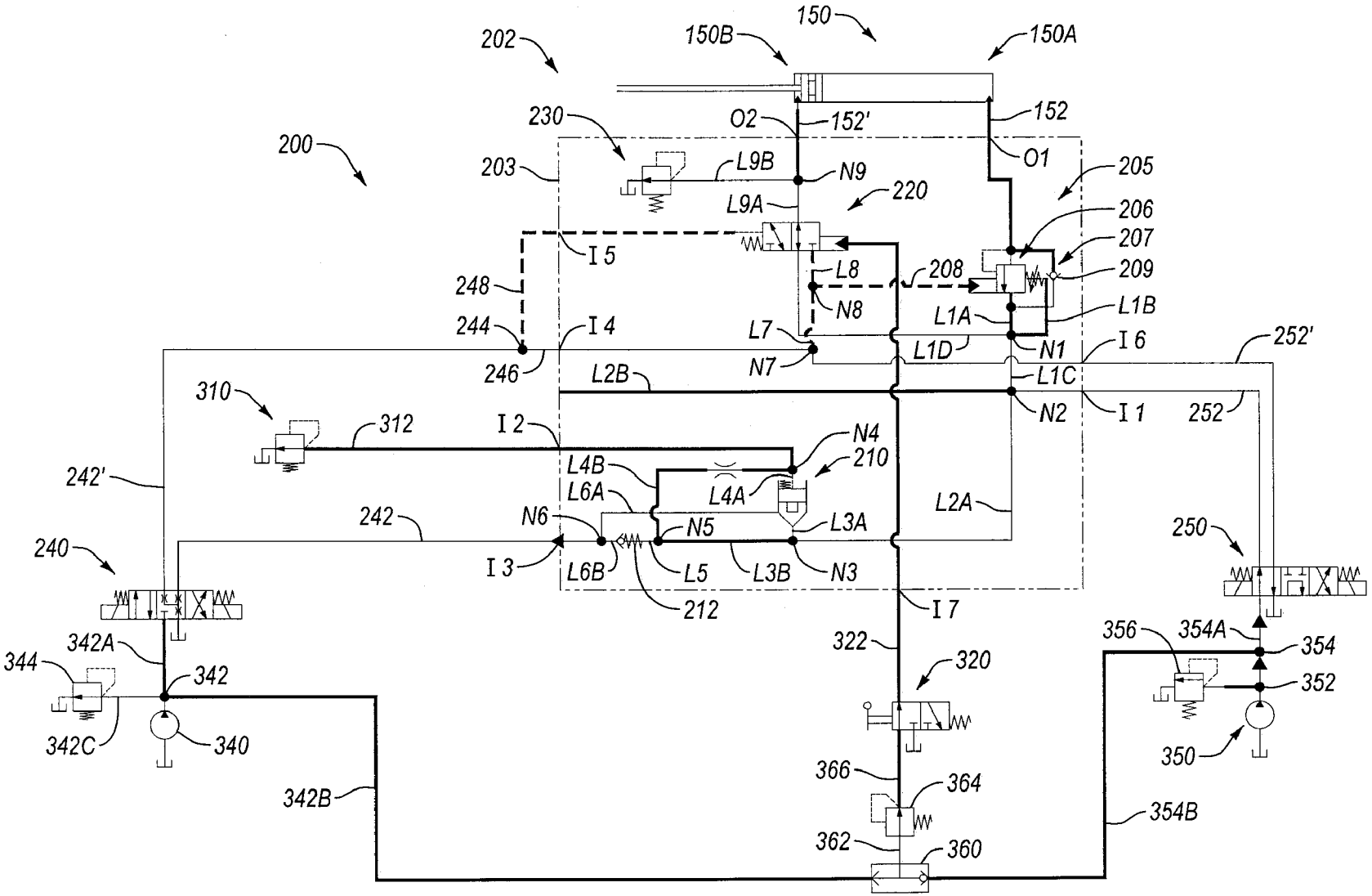
FIG. 3C illustrates a diagrammatic view of a valve system in a fast feed plus differential extending mode according to one example.

FIG. 3C illustrates a fast feed plus differential extension mode. As shown in FIG. 3C, if the fast feed differential valve 220 is actuated a pathway is established between the ring side 150B and the piston side 150A. As discussed above, directing the fluid from the ring side 150B to the piston side 150A can increase the volume of flow directed to the piston side 150A and thus the rate at which the feed cylinder 150 extends.

Figure 4A:
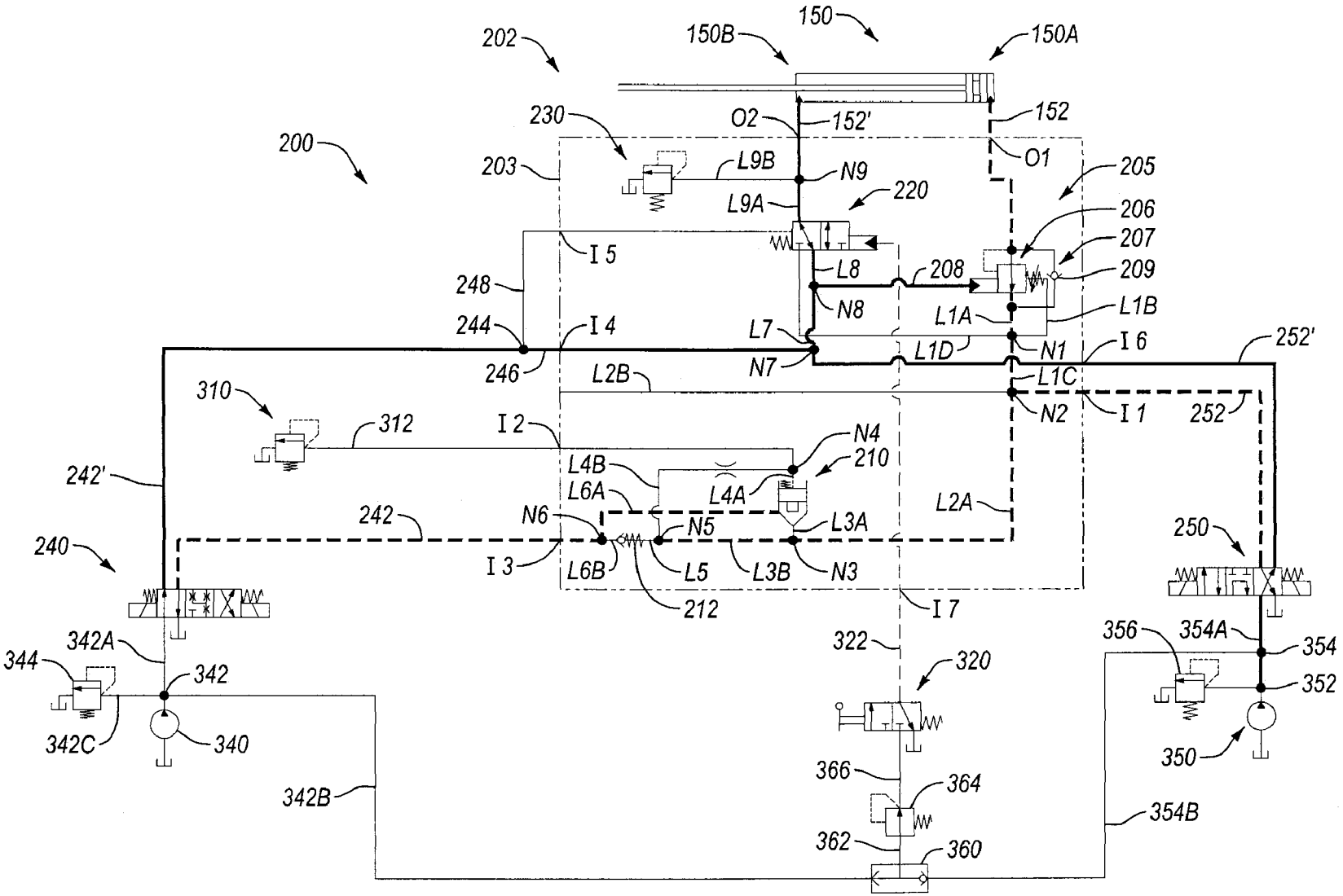
FIG. 4A illustrates a diagrammatic view of a valve system in a feed/fast feed retraction mode according to one example.
Figure 4B:
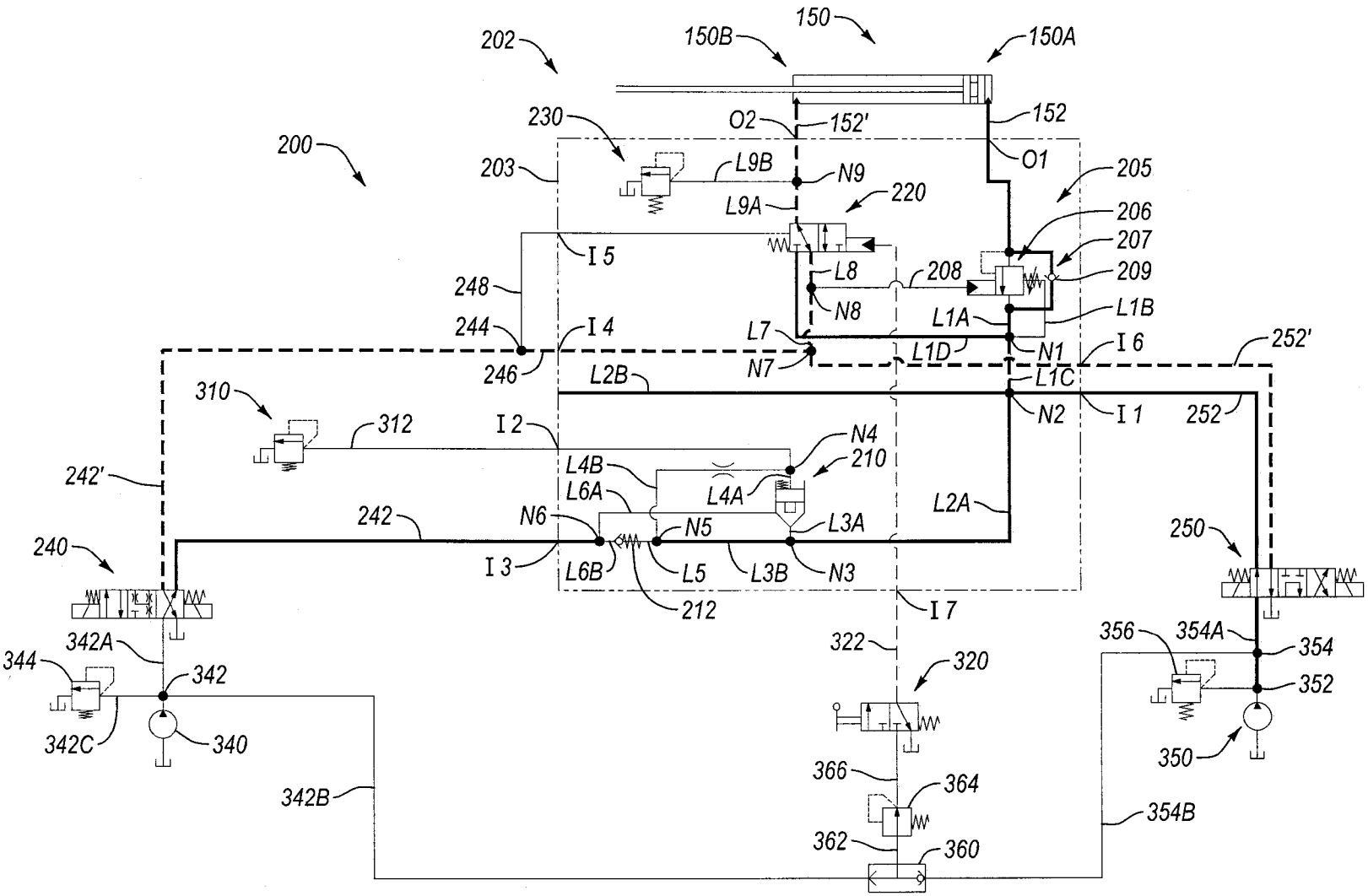
FIG. 4B illustrates a diagrammatic view of a valve system in a feed/fast feed extension mode according to one example.
Figure 4C:
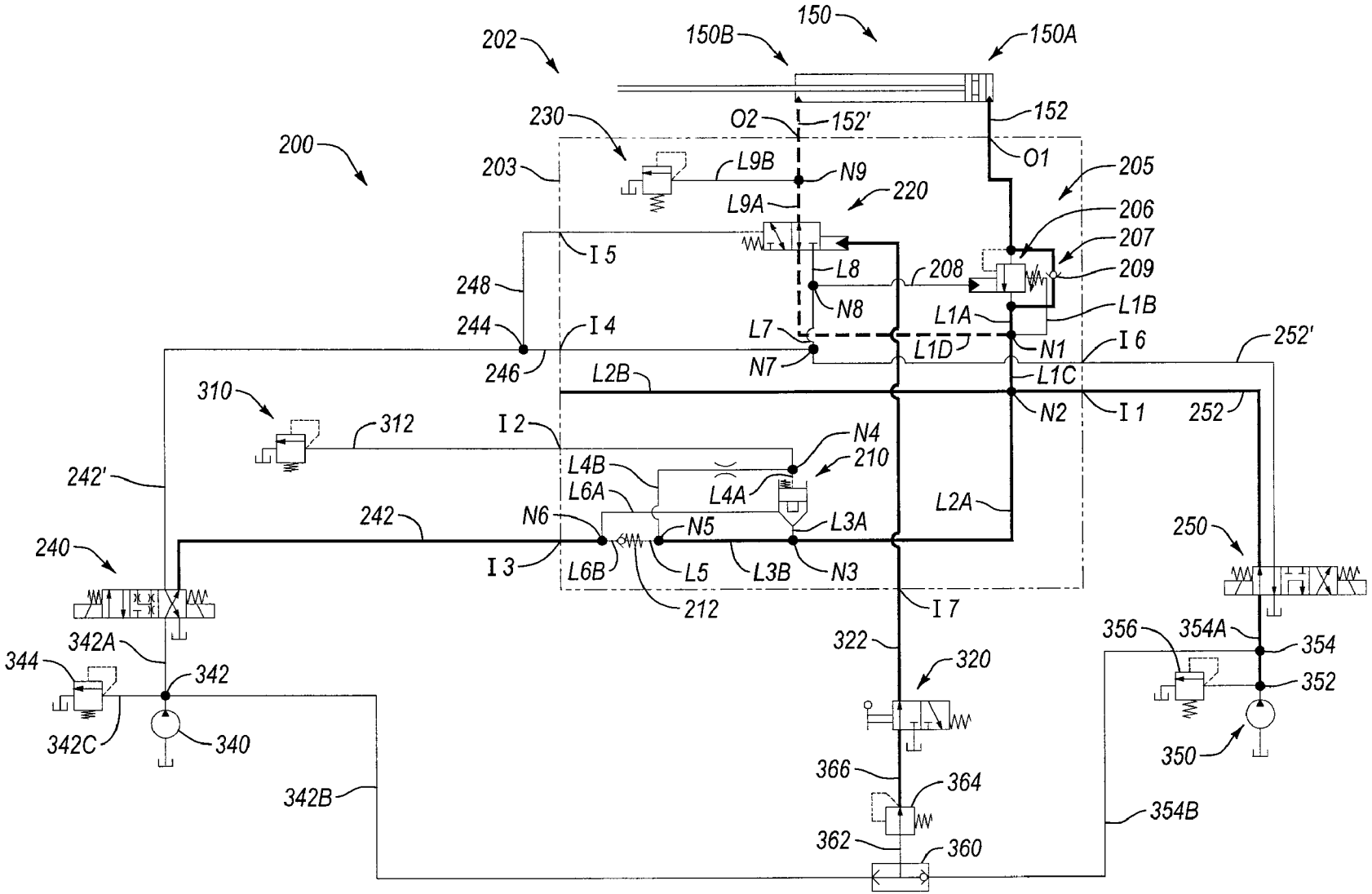
FIG. 4C illustrates a diagrammatic view of a valve system in a feed/fast feed plus differential extending mode according to one example.

To this point, operation of the valve system 200 has been discussed in the context of the feed directional valve 240 or the fast feed directional valve 250 being switched to direct fluid to the valve block assembly 202. FIGS. 4A-4C illustrate feed modes in which the feed directional valve 240 and the fast feed directional valve 250 are both switched to provide feed/fast feed retraction, feed/fast feed extension, and feed/fast feed plus differential extension modes respectively.

FIG. 4A illustrates the feed/fast feed retraction mode. In the feed/fast feed retraction mode, the feed directional valve 240 is switched to couple line 242' to the output of the feed pump 340 while fast feed directional valve 250 is switched to couple line 252' to the output of the fast feed pump 350. Both lines 242' and 252' are in communication with node N7. As previously discussed, fluid directed to node N7 acts to open the pressure holding valving 206 to allow the piston side 150A to drain while directing fluid to the ring side 150B to counter the drain of fluid from the piston side 150A.

In particular, in the feed/fast feed retraction mode the piston side 150A is in communication with node N2. Node N2 is in communication with line 252 via outlet I6 and with line 242 by way of the feed balancing valve 210 as previously discussed. Lines 242 and 252 are both coupled to tank in the feed/fast feed retraction mode.

FIG. 4B illustrates the feed/fast feed extension mode. In this mode, the feed directional valve 240 is switched to couple the output of the feed pump 340 to line 242 while fast feed directional valve 250 is switched to couple the output of the fast feed pump 350 to line 252. Lines 242 and 252 are both in communication with node N2 through pathways described above. Fluid directed to node N2 is directed to the piston side 150A of the feed cylinder 150 through the proportional valving 206 and the check valve 209 of the load holding valve 205 to thereby cause the feed cylinder 150 to extend.

As the feed cylinder extends 150, fluid drains from the ring side 150B. In particular, the ring side 150B is in communication with node N7, which is in communication with lines 242, 252 as previously discussed. In the feed/fast feed extension mode, the feed directional valve 240 and the fast feed directional valve 250 are switched to couple the lines 242, 252 with the tank, thereby providing a drain pathway for the ring side 150B.

FIG. 4C illustrates the feed/fast feed plus differential extension mode. As previously discussed, in a differential extension mode, the fast feed differential feed 220 is switched to couple node N9 to node N1 to thereby feed the fluid outlet from the ring side 150B to the piston side 150A as previously discussed.

Accordingly, the feed directional valve 240, the fast feed directional valve 250, and the fast feed control pilot 320 may be independently switched to provide a wide range of feed speeds and directions. In at least one example, the feed directional valve 240, the fast feed directional valve, 250, the feed balancing pilot control 310, and/or the fast feed control pilot 320 may be manually actuated through knobs, levers, or other manual switches. In other examples, electronic control may be utilized to actuate any or all of the valves and controls discussed herein.

In the example discussed above, the valve system 200 is discussed with reference to a valve block assembly 202. It will be appreciated however that the various components described above may be implemented in any number of ways and/or may be integrated in any number of ways.

Figure 5A:
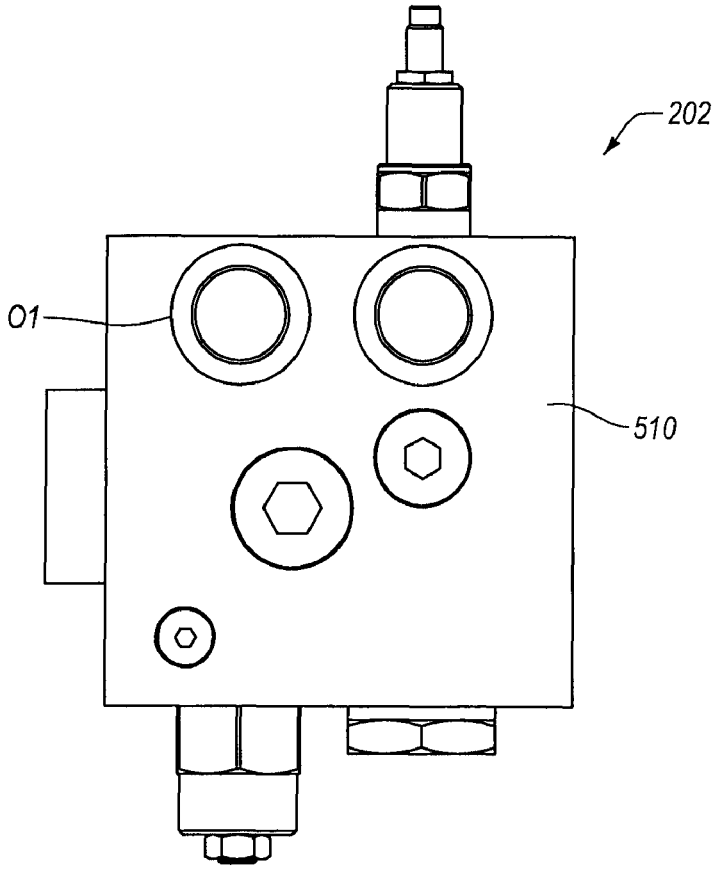
FIGS. 5A-5D illustrate a valve assembly integrated in a valve block according to one example.
Figure 5B:
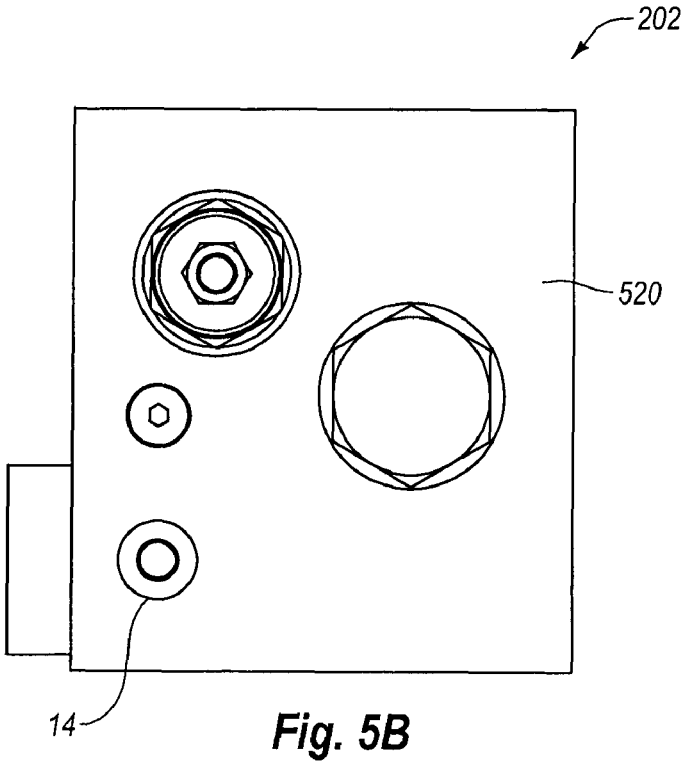
Figure 5C:
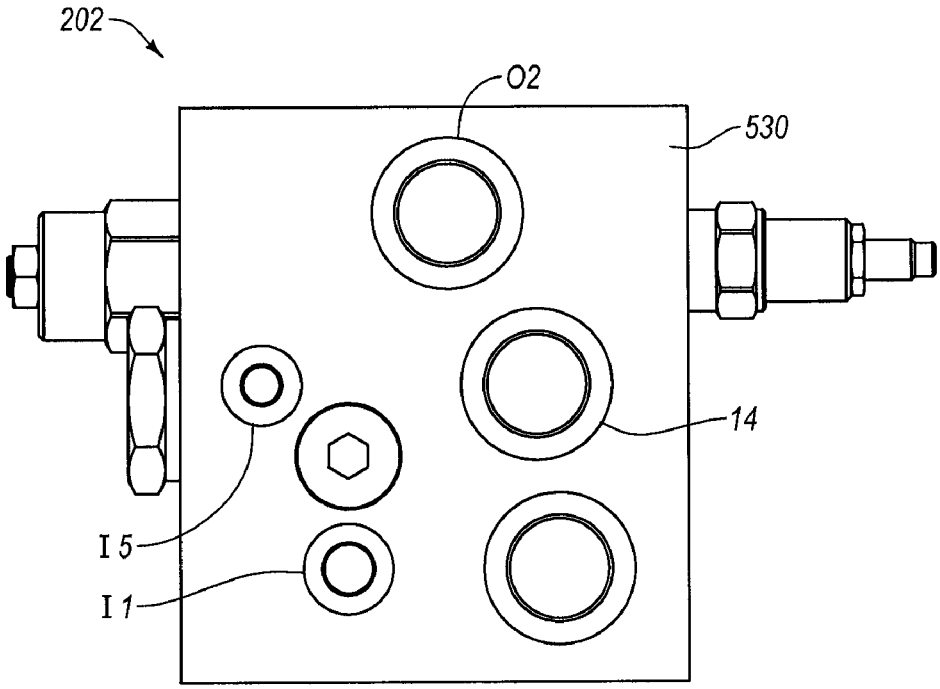
Figure 5D:
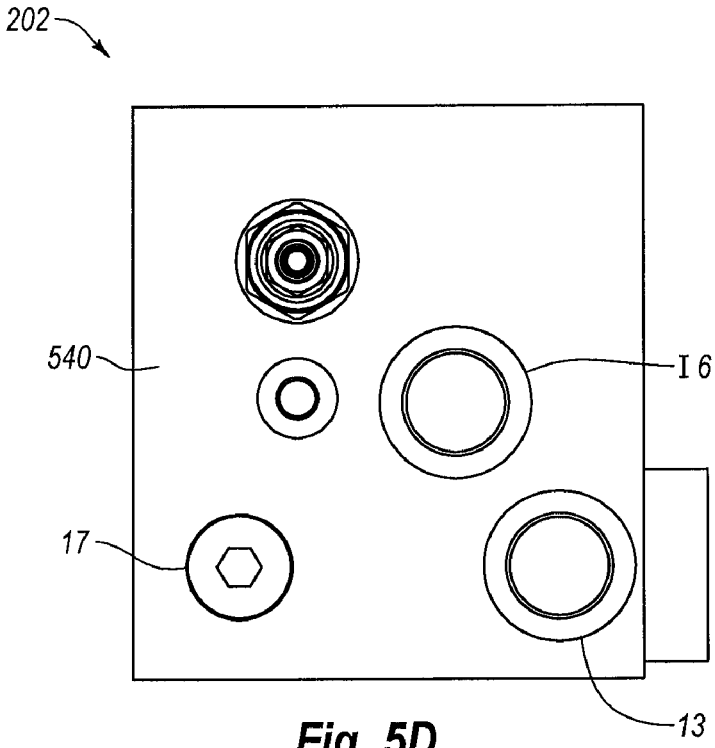

FIGS. 5A-5D illustrate one implementation of the valve block assembly 202. In particular, FIG. 5A illustrates a top view of the valve block assembly 202 while FIGS. 5B-5D illustrate lateral side views of the valve block assembly 202.

As illustrated in FIG. 5A the first outlet O1 may be defined in a top side 510 of the valve block assembly 202.

As illustrated in FIG. 5B, inlet I4 may be defined in a first lateral side 520 of the valve block. As shown in FIG. 5C, outlet O2, inlets I1, I4, and I5 may be defined in a second lateral side 510, the second lateral side being adjacent the first lateral side 520. FIG. 5D illustrates the third lateral side 540, which is adjacent the second lateral side 530 and thus positioned on an opposing side of the valve block assembly 202 as the first lateral side 520. As shown in FIG. 5D, inlets I3, I6, and I7 may each be defined in the valve block assembly 202.

As will be appreciated in view of FIGS. 5A-5D in light of FIGS. 2A-4C, the load holding valve 205, the feed balancing valve 210, the fast feed differential valve 220, and the safety valve 230 can be integrated into the valve block assembly 202.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A valve system, comprising:

a load holding valve;

a feed balancing valve in fluid communication with said load holding valve; and a fast feed differential valve, wherein said fast feed differential valve is configured to move between an engaged state and a disengaged state, wherein in the engaged state said fast feed differential valve fluidly couples a ring side of a feed cylinder, said load holding valve, and a piston side of the feed cylinder to allow fluid to flow from the ring side to the piston side.

2. The valve system of claim 1, wherein the load holding valve includes pressure holding valving and proportional valving, wherein said load holding valve is configured to move from a closed state to an open state in response to pressure incident on an actuator line coupled to said pressure holding valving, wherein in said closed state said pressure holding valving prevents fluid from passing from the piston side through said load holding valve.

3. The valve system of claim 1, wherein said proportional valving is configured to allow fluid to flow through said load holding valve in a first direction to the piston side of the feed cylinder and to prevent fluid from flowing from the piston side of the feed cylinder through said load holding valve in a second direction, the second direction being opposite the first direction.

4. The valve system of claim 1, further comprising a safety valve operatively associated with said fast feed differential control.

5. The valve system of claim 1, further comprising a feed directional valve configured to switch between a feed refraction mode and a feed extension mode, wherein in the feed retraction mode the feed directional valve directs fluid from a feed pump to said load holding valve to move said load holding valve from a closed state to an open state, wherein in said open state a fluid pathway is established between the piston side of the feed cylinder and said feed balancing valve.

6. The valve system of claim 5, wherein when said feed directional valve is switched to said feed extension mode, said feed directional valve directs the fluid from the feed pump through said feed balancing valve and through said load holding valve to the piston side of the feed cylinder.

7. The valve system of claim 5, further comprising a fast feed directional valve configured to switch between a fast feed retraction mode and a fast feed extension mode, wherein in the fast feed retraction mode the fast feed directional valve directs fluid from a fast feed pump to said load holding valve to move said load holding valve from said closed state to said open state.

8. The valve assembly of claim 7, wherein when said fast feed directional valve is switched to the fast feed extension mode, said feed directional valve directs the fluid from the fast feed pump through said load holding valve to the piston side of the feed cylinder.

9. The valve assembly of claim 7, wherein said feed directional valve and said fast feed directional valve may be switched independently.

10. The valve assembly of claim 1, wherein said load holding valve, said feed balancing valve, and said fast feed differential valve are housed in a single valve block.

11. A valve block assembly, comprising:

a valve block having a first outlet and a second outlet, said first outlet being configured to be coupled to a piston side of a feed cylinder and said second outlet being configured to be coupled to a ring side of the feed cylinder;

a load holding valve housed in said valve block and operatively associated with said first outlet;

a feed balancing valve housed in said valve block, said feed balancing valve being in fluid communication with said load holding valve; and a fast feed differential valve housed in said valve block, said fast feed differential valve being configured to switch from a disengaged state to an engaged state, wherein in said engaged state said fast feed differential valve directs fluid from said second outlet to said first outlet.

12. The valve block assembly of claim 11, wherein said load holding valve includes proportional valving and wherein when said fast feed differential valve is in said engaged state said fast feed differential valve directs fluid from said second outlet, through said proportional valving, and to said first outlet.

13. The valve block assembly of claim 11, said load holding valve further comprising pressure holding valving and an actuator line coupled to said pressure holding valving, wherein pressure acting on said pressure holding valving moves said pressure holding valve from a closed state to an open state, wherein in the open state a fluid pathway is established between said first outlet and said feed balancing valve.

14. The valve block assembly of claim 13, further comprising a first inlet defined in said valve block and a second inlet defined in said valve block, said first inlet being in communication with said feed balancing valve and said second said inlet being in communication with said actuator line and said fast feed differential valve.

15. The valve block assembly of claim 14, wherein said first inlet and said second inlet are configured to receive input from a feed pump.

16. The valve block assembly of claim 14, further comprising a third inlet and a fourth inlet defined in said valve block, said third inlet being in communication with at least one of said pressure holding valving or proportional valving of said load holding valve, and said fourth inlet being in communication with said actuator line and said fast feed differential valve.

17. The valve block assembly of claim 11, further comprising a safety valve housed in said block and in communication with said second outlet.

18. A valve block assembly, comprising:

a valve block having a first outlet and a second outlet, said first outlet being configured to be coupled to a piston side of a feed cylinder and said second outlet being configured to be coupled to a ring side of the feed cylinder;

a load holding valve housed in said valve block and operatively associated with said first outlet;

a feed balancing valve housed in said valve block;

a fast feed differential valve housed in said valve block;

a first inlet defined in said valve block, said first inlet being in communication with said feed balancing valve, a second inlet defined in said valve block, said second inlet being in communication with a first node; and a third inlet defined in said valve block, said third inlet being in communication with said first node, wherein said first node is in communication with said fast feed differential valve and said valve holding block, wherein fluid directed from said first inlet to said first node or said second inlet to said first node acts to establish a fluid pathway between said first outlet and said feed balancing valve.

19. The valve block assembly of claim 18, further comprising a third inlet, said third inlet being in communication with a second node, said second node being in communication with said feed balancing valve and said load holding valve, wherein fluid directed from said second node to said load holding valve passes through said load holding valve to said first outlet.

20. The valve block assembly of claim 19, further comprising a fourth inlet, said fourth inlet being in communication with said feed balancing valve, wherein fluid directed to said feed balancing valve from said fourth inlet passes through said feed balancing valve to said second node.

21. The valve block assembly of claim 20, wherein said first inlet and said fourth inlet are configured to receive an input from a feed pump and said second inlet and said third inlet are configured to receive an input from a fast feed pump.

22. A valve system for use in a drilling system, comprising:

a load holding valve;

a feed balancing valve in fluid communication with said load holding valve;

a feed balancing pilot control in communication with said feed balancing valve, said feed balancing pilot control being configured to control pressure in a fluid pathway between said load holding valve and said feed balancing valve;

a fast feed differential valve; and a fast feed pilot control in communication with said fast feed differential valve, said fast feed pilot control being configured to move said fast move said fast feed differential valve between an engaged state and a non-engaged state, wherein in said non-engaged state said fast feed differential valve is configured route fluid to a tank and in an engaged state said fast feed differential valve is configured to route the fluid from a ring side of a feed cylinder to a piston side of the feed cylinder.

23. The valve system of claim 22, further comprising a feed directional control, said feed directional control being configured to selectively couple an output of a feed pump to a first feed line and a second feed line, said first feed line being in fluid communication with said feed differential valve and said load holding valve and said second feed line being in fluid communication with said feed balancing valve.

24. The valve system of claim 23, wherein directing fluid through said first feed line to said load holding valve moves pressure holding valving of said load holding valve from a closed state to an open state.

25. The valve system of claim 23, wherein directing fluid through said second feed line causes fluid to flow through said proportional valving of said load holding valve.

26. The valve system of claim 23, further comprising a fast feed directional control, said fast feed directional control being configured to selectively couple an output of a fast feed pump to a first fast feed line and a second fast feed line, said first fast feed line being in fluid communication with said fast feed differential valve and said load holding valve and said second fast feed line being in fluid communication with said load holding valve and said feed balancing valve.

* * * * *